United States Patent [19]

Haneda et al.

[11] Patent Number: 4,624,559

[45] Date of Patent: Nov. 25, 1986

[54] DEVELOPING METHOD FOR ELECTROSTATIC LATENT IMAGE

[75] Inventors: Satoshi Haneda; Masahiko Itaya; Makoto Tomono, all of Hachioji, Japan

[73] Assignee: Konishiroku Photo Industry Co., Ltd., Tokyo, Japan

[21] Appl. No.: 828,574

[22] Filed: Feb. 10, 1986

Related U.S. Application Data

[63] Continuation of Ser. No. 736,393, May 17, 1985, abandoned, which is a continuation of Ser. No. 435,105, Oct. 18, 1982, abandoned.

[30] Foreign Application Priority Data

Oct. 20, 1981 [JP] Japan ..... 56-167705

[51] Int. Cl.[4] ..... G03G 15/08

[52] U.S. Cl. ..... 355/14 D; 355/3 DD; 118/624; 430/35

[58] Field of Search ..... 355/3 R, 3 DD, 14 D

[56] References Cited

U.S. PATENT DOCUMENTS 4,370,049 1/1983 Kuge et al. ..... 355/14 D X 4,378,158 3/1983 Kanbe ..... 355/14 D X

*Primary Examiner*—A. C. Prescott

*Attorney, Agent, or Firm*—Bierman, Peroff & Muserlian

[57] ABSTRACT

A developing method for an electrostatic latent image comprises the steps of applying and retaining a layer of developer on a supporting sleeve, conveying the developer on the supporting sleeve to a development area, and regulating the quantity of the developer on the supporting sleeve by a developer regulating device before the developer is conveyed to the development area. The regulating step includes impressing a bias voltage so as to establish a field between the supporting sleeve and the regulating device in order to selectively retain developer on the supporting sleeve which has a desired polarity and quantity of charge for development. The developer regulating device may be a sleeve rotated in a direction opposite to the direction of rotation of the supporting sleeve, and has a bias voltage impressed thereon.

27 Claims, 6 Drawing Figures

DEVELOPING METHOD FOR ELECTROSTATIC LATENT IMAGE

This is a continuation of U.S. application Ser. No. 736,393 filed May 17, 1985, now abandoned, which is a continuation of U.S. application Ser. No. 435,105 filed Oct. 18, 1982, now abandoned, which claims the priority of Japanese application Ser. No. 167705/81 filed Oct. 20, 1981.

BACKGROUND OF THE INVENTION

1. Field of the Invention

The present invention relates to a developing method for an electrostatic latent image which is formed in xerography, electrostatic printing, electrographic recording using a one-component developer.

2. Description of the Prior Art

Generally, wet development using a liquid developer and dry development using a powder developer are known and have previously been used to form a visual image after developing an electrostatic latent image. The dry development is advantageous in that it uses a plain paper, and the process is classified into two major methods: a method using a two-component developer consisting essentially of carrier and toner, and a method using a one-component developer consisting essentially of toner.

The developing method using a one-component developer is superior to the method using a two-component developer in some respects. Specifically, the method does not intrinsically produce changes in the density of toner, thereby enabling the structure of a developing machine to be kept simple, and the characteristics of the developer are stable over a long term without deterioration. However, this method is quite disadvantageous in that it cannot form images stably, because it is difficult to bring a one-component developer into any desired charged state, and because it is difficult to use such a developer on a surface for an electrostatic latent image in its desired state upon developing.

In order to have a good visual image using dry development, it is necessary to charge toner so that it has an appropriate quantity of charge which is opposite in polarity to an electrostatically charged image to be developed. The method using a two-component developer mechanically stirs toner and carrier to frictionally electrify the toner, so that the polarity and quantity of charge of the toner can be controlled to a considerable extent by selecting characteristics of the carrier, conditions of stirring, etc. However, in the method using a one-component developer consisting only of toner, there exists no such carrier, thus rendering control of polarity and quantity of charge of toner very difficult.

For charging a one-component developer, frictional charging using a mechanical force, charge injection electrification using an electrode that is injected and charging using a corona discharger are known.

The method using frictional charging employs friction between toner and any one of a stirrer, a conveyance member or the wall of a container of friction among particles of toner to charge the toner. The result is that the quantity of charge is generally limited and its magnitude cannot be controlled with ease. Further disadvantageously, as a consequence of such process, a portion of toner may be electrified to have a polarity opposite to the necessary polarity. A method using electric and magnetic forces to move toner on a charging member is capable of charging the toner considerably, but it is difficult for this method to totally remove toner having the opposite polarity.

Charge injection electrification has the disadvantage that if the developer is insulative, then it is difficult to inject charge, while if it is electrically conductive, leak tends to occur. Therefore, it is impossible to obtain a large quantity of charge.

Electrification using a corona discharger is disadvantageous in that it is unable to electrify developer uniformly.

Various means (referred to "developing means" hereinafter) for causing a charged one-component developer to work on a charge receptor which forms an electrostatic latent image are known, and they are classified by the following methods: a contacting development method, such as an impression method, in which developer is brought into contact with the total surface of the charge receptor; a non-contacting development method in which an electric field causes toner to adhere without bringing developer into contact with the total surface of the charge receptor, such as described in U.S. Pat. No. 3,866,574, or Japanese Patent Laid-Open to Public Inspection Nos. 18656/1980 through 18659/1980, for example, or by a touchdown method.

Generally, it is necessary for development using a one-component developer to move the developer, that is toner, to a developing station, while it is unipolarly charged, whether the method is a contact development or noncontacting development. Development using bipolarly charged toner cannot obtain a high-quality visual image, because toner of the opposite polarity adheres to the edge of an image, thus to deteriorate the quality of the image, and because toner of opposite polarity adheres to the background resulting in fog.

Particularly, the noncontacting development requires that toner is unipolarly charged, and that a thin layer (thickness equivalent to several particles of toner) is formed quite uniformly on a developing sleeve. If the thickness of toner is too great, then overdevelopment will occur, and massed particles of toner will participate in development without being separately emitted, resulting in deterioration in image quality. Further disadvantageously, toner is emitted excessively.

SUMMARY OF THE INVENTION

It is an object of the present invention to provide a developing method for an electrostatic latent image which solves the aforementioned problems involved in development using a one-component developer.

In development using a one-component developer, toner is bipolarly charged, and positively charged toner and negatively charged toner are mixed together. According to the present invention, toner which is unipolarly charged is selectively held on a developer supporting means by a developer regulating means and is transported to a developing station.

In one preferred embodiment of the present invention, an electrostatic latent image is developed in a noncontacting development method.

If the present invention is applied to the noncontacting development, various advantages will be offered as described hereinafter.

For example, an electrostatic latent image is developed in a noncontacting manner using emisson of toner in an alternating electric field. This is due to the fact that if the image is developed in a contacting manner, even when the surface potential of a charge receptor is zero, the presence of charge in the toner produces a mirror force causing the toner to adhere to the receptor, thereby forming fog leading to deterioration in image quality. When the present invention is applied to contacting development, a rubbing force, such as electric force or magnetic force, greater than the force needed in noncontacting development is required to remove fog.

Heretofore, one example of noncontacting development has been disclosed in U.S. Pat. No. 3,866,574, in which the quantity of charge on a thin layer of toner is controlled by corona electrification and then the toner is directly transported to a developing station. However, charge control and formation of the toner layer of this method encounter difficulties. As an improvement over this, a method for forming a charged thin layer of a magnetic toner using a magnetic blade has been proposed in Japanese Patent Laid-Open to Public Inspection Nos. 125844/1978 and 93177/1980, but this method is also accompanied by similar difficulties. Japanese Patent Laid-Open to Public Inspection No. 22926/1977 discloses a method, in which a charged thin layer of toner is formed on a charging roller and then it is removed therefrom by a mechanical means for application onto an applicator roller. This attempt also has difficulties in charging of toner on the charging roller and in formation of a thin film. Another method using two rollers is disadvantageous in that it does not allow miniaturization of the machine.

As aforesaid, the prior art noncontacting development methods neither obtain the necessary charged states, such as in the polarity of the charge and quantity of the charge, nor transport a charged thin film of toner to a developing station. As a result, it was difficult to obtain good visual images stably. On the other hand, the method using two rollers is superior over the above developments in these respects, but it is disadvantageous in that it does not allow miniaturization.

According to the present invention, the foregoing disadvantages are effectively removed.

DETAILED DESCRIPTION OF THE PREFERRED EMBODIMENTS

The present invention is described hereinafter in detail with reference to the drawings.

Figure 1:
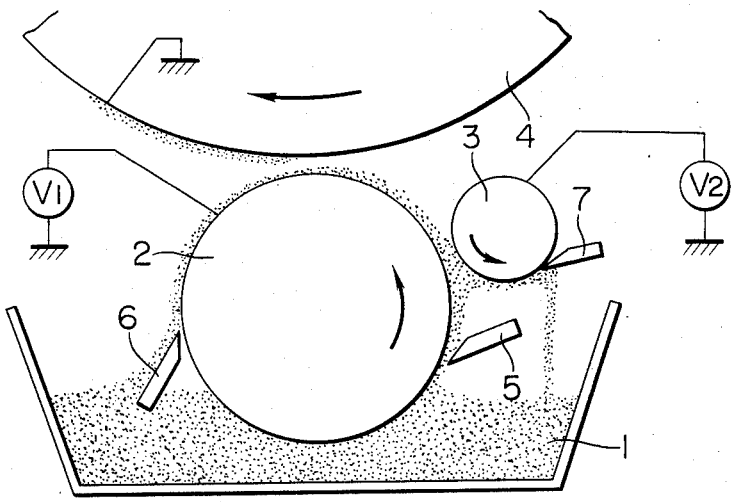
FIG. 1 shows a cross sectional view of a developing device illustrating the development method of the present invention utilizing a counter-rotating sleeve as a developer regulating means.

Referring first to FIG. 1, the present invention is outlined. Some examples of the present invention will be described later with reference to FIG. 2 and the following figures.

Toner in a toner container 1 adheres to a developer supporting means 2 and is conveyed by said means. A film of toner having a uniform thickness on the surface of the developer supporting means is formed by a blade 5, but the thickness is too great to be used for development. Also, this layer of toner may be sometimes mixed with toner of unwanted polarity. Consequently, it is effective to provide a charging means, such as the aforementioned frictional charging, charge injection electrification using an injection electrode or charging using a corona discharger, in association with the toner on the developer supporting means 2.

The layer of toner on the developer supporting means 2 is selectively moved toward a developer regulating means 3 which rotates. The supporting means 2 and the regulating means 3 form a certain space therebetween. The charge of the layer of toner on the supporting means 2 is not completely homogeneous, and therefore the part of the toner which has a desired polarity and a large quantity of charge is selectively prevented from being moved to the regulating means 3 by the use of an electric force.

The layer of toner thus re-formed on the developer supporting means 2 after the regulating means 3 is quite thin and uniform and consists of several particles of the toner in thickness. If the radii of the particles are assumed to be 1–30 $\mu$m, then the thickness of the film is less than 300 $\mu$m. Since an electric force is used for preventing the toner on the supporting means 2 from moving to the regulating means 3, the charge is well under control. In order to increase the quantity of the charge or to more fully control the charge, the aforesaid charging means may be used.

The developer supporting means 2 is moved close to a charge receptor 4 retaining an electrostatic latent image, but is not in contact with it. The latent image on the charge receptor 4 is developed by the aforementioned thin layer of toner on the periphery of the supporting means 2, and the toner is partially moved onto the charge receptor 4. The remaining toner on the periphery of the supporting means 2 and on the regulating means 3 is rubbed off therefrom with a blade 6 and a blade 7 and is recovered in the toner container 1 if necessary.

In order to form a toner film of the desired thickness on the developer supporting means 2, said means 2 is rotated so that its peripheral velocity is equal to or higher than that of the developer regulating means 3, thereby increasing the conveying capacity of the supporting means. Alternatively, the electric field between the developer supporting means 2 and the developer regulating means 3 may be adjusted to limit the quantity of conveyed developer. Particularly if the toner is a one-component magnetic developer (referred to as "magnetic toner" hereinafter), said toner can be conveyed by a magnetic force. If the developer supporting means 2 is a structure having a rotary sleeve and magnets to more critically select the toner, or if the conveying capacity of the developer regulating means 3 is increased to exert a greater force on the moving toner, then the thickness of toner can be decreased while a larger electric force is generated between the developer supporting means 2 and the developer regulating means 3. In FIG. 1, the rotational directions of the supporting means 2, regulating means 3 and charge receptor 4 are indicated by their respective arrows, but the present invention is not restricted to these directions.

Next, the operative elements used for the aforementioned development are individually described.

The developer supporting means or developer regulating means contains a magnetic member and conveys a magnetic toner. At the developing station, a uniform layer of toner not exceeding about 10 particles in thickness is required to be formed. These members can attain the objects of the present invention by being constructed or combined as follows.

(1) The developer supporting means consists essentially of magnets, which are disposed so that the north poles and south poles are alternately arranged, and a non-magnetic sleeve housing the magnets. The sleeve is made of aluminium, brass, non-magnetic stainless steel or the like. The number of poles of the magnets ranges from 4 to 20, and the magnets are so selected that the maximum magnetic force on the sleeve exceeds 200 gauss, typically on the order of 400–1500 gauss, taking account of conveyance of the toner.

A cylinder having a diameter roughly ranging from 10 mm to 100 mm depending on the requirements of the developing device is usually used for each roller of the developer supporting means and developer limiting means. Of course, each roller can be replaced by a belt. The conveyed quantity of toner is determined by the magnetic force of the magnets, number of the magnetic poles and rotating speeds of the sleeve and magnets (transfer velocities in case of belts) except for the magnetism of the toner and should assure that toner is sufficiently supplied to the developing station. Further, the periphery velocities of the sleeve and magnets should be roughly equal to or exceed the transfer velocity of the electrostatic latent image. The transfer velocity of an ordinary electrostatic latent image is several hundreds mm/sec, and therefore the rotational speed of the magnets of the developer supporting means or developer regulating means is 500–5,000 rpm, and the rotational speed of the sleeve is 20–500 rpm. The magnets and sleeve can rotate in the same direction and also in the opposite directions. The direction in which the toner on the developer regulating means is conveyed can be opposite to the transfer direction of the toner on the developer supporting means.

(2) The developer regulating means is made of magnets fixedly disposed within a non-magnetic sleeve made of aluminium, brass, non-magnetic stainless steel or the like. By so arranging the stationary magnets in the regulating means that their lines of magnetic force spread toward the supporting means, a uniform film of toner is formed on the supporting means. The magnets are so selected that the magnetic force on the sleeve exceeds 200 gauss.

(3) In order to develop an electrostatic latent image stably, a stabilized supply of toner to the developing station is required. To accomplish this, a stabilized formation of a magnetic brush on the supporting means is needed. It is effective for this purpose to provide a preliminary regulating means for the layer of toner supplied onto the supporting means prior to the developer regulating means. The preliminary regulation does not need to be assigned the critical task of forming toner into a thin layer. Usually this kind of regulating means employs a blade made of a knife-like metal or resin. Also, as the supporting means houses the magnets, a blade made of a magnetic material can be used. Specifically, if the magnets in the supporting means rotate, the toner can be regulated by disposing a pair of cylindrical magnetic bodies made of a material that is easily magnetizable, such as iron, ferrite or the like, diametrically opposite to each other. On the other hand, if the magnets in the developer supporting means are stationary, toner can be regulated by disposing a knifelike magnetic body of an easily magnetizable material, as aforementioned, or a magnet having the opposite polarity diametrically opposite to one of the magnets. A magnetic blade utilizing such a magnetic arrangement has advantages including (1) loosened precision in regulation, (2) less tendency to solidify toner particles, and (3) permitting formation of a relatively thin layer.

(4) It is necessary to supply an appropriate quantity of developer to an electrostatic latent image on each occasion while several layers of toner are deposited on the sleeve. To satisfy this condition, the transfer velocity of toner on the developer supporting means is required to be roughly equal to or higher than the transfer velocity of the latent image. As supply of toner to a charge receptor depends on supply of toner from the developer supporting means, the former supply of toner is required to have a similar relationship with the latent image and supporting means. Whatever directions in which the latent image and supporting means move, respectively, are selected, a certain quality of image characteristics may be assured, and such arrangement may be put into practical use. However, an arrangement in which an electrostatic latent image and the developer supporting means move in the same direction tends to produce a resolution higher than a resolution obtained from a scheme in which both move in opposite directions. This is accounted for by the following facts. In a development where the latent image and supported means move in the same direction the image always passes a position that lies in the closest proximity to the developer supporting means, whereby the image is always developed under the strongest electric field, whereas in a development where they move in the opposite directions the latent image is partially developed until it reaches the aforementioned closest position and so all toner is not necessarily developed under a strong electric field.

The linear velocity $V_0$ of the surface on which the charged image is formed, the linear velocity $V_1$ of the developer supporting means and the linear velocity $V_2$ of the developer regulating means preferably satisfy the following relations:

$$|V_0| \leqq |V_1|/2,$$

$$|V_1| \leqq |V_2|/2$$

In addition, if $$V_0/V_1 \leqq \tfrac{1}{2}$$

holds between the surface on which the image is formed and supporting means, then a good quality development will be accomplished.

(5) Many one-component developers contain a magnetic material, which in turn is simply used for conveyance of toner and frictional charging. Therefore, a non-contacting development employing no magnetic field can use a magnetic toner containing less magnetic material than heretofore. Owing to this, various advantages are offered as follows: (1) ease of fixation, (2) ease of process, as exemplified by mixing of a resin and a magnetic material, (3) improved resistance to moisture, (4) improved insulation, (5) improved charge controllability, and (6) facilitated conditions of development due to lighter toner.

Characteristics important to a one-component developer are (1) electrical characteristics, (2) mechanical characteristics and (3) thermal and rheological characteristics, and toner is prepared taking these into account.

Generally, the toner contains the following ingredients excepting magnetic material:

(i) thermoplastic resin: used as a binder either by itself or by being mixed with another material: 80–90% by weight (ii) pigment: colorant: 0–15% by weight (iii) charge controlling agent: used for controlling the polarity of electric charge, quantity of charge and so on: 0–5% by weight (iv) other ingredients: fluidizer, cleaning agent, filler and so on which may become important later on (i) through (iv) above are described more fully in the following.

(i) resin

Typical resins are polystyrene, styrene-acrylates or methacrylates copolymer, polyester, polyvinyl butyral, epoxy resin, polyamide resin, polyethylene, ethylene-vinyl acetate copolymer, etc. Mixtures of some of these resins are often used to obtain appropriate physical properties.

(ii) pigment

Particulates of carbon black are nearly exclusively used for ordinary black-and-white duplication, but Nigrosine, Spirit black (dye) and so forth, which are also used for charge control, are similarly used. Quantity of charge, electric resistance and other characteristics of toner are affected by the type of carbon black used and the process of mixture of additives.

(iii) charge controlling agent

A two-component toner is given electric charges by frictional charging with a carrier, while a one-component toner has no carrier. Therefore, the latter toner requires positive frictional charging with a roller, blade or electrification member. The electric resistance of toner affects the quantity of charge and its preservation, and it is usually selected to exceed $10^{10}$ Ωcm. Charging methods of toner include (1) frictional charging, (2) corona charging and (3) electrostatic induction (charge injection), it being noted that the frictional charging is most commonly used. A charge control can use a charge controlling agent, but a resin having polar groups can be used instead. For example, for negative charging electron attractive chlorine and fluorine can be used, or for positive charging an electron donative substituent containing oxygen (such as C=O and C—O), substituent containing basic nitrogen (—C—N—) or the like can be used.

Electron donative Nigrosine dyes are principally used as charge controlling agents for (+) toner, and electron attractive organic complexes are useful for (−) toner. Further, metallic salts of naphthenic acid and higher fatty acids, alkoxy amine, quaternary ammonium salts, alkyl amides, phosphorus, tungsten, molybdic acid lake pigments, fluorinated activators, etc. are proposed for (+) toner, and chlorinated paraffin, chlorinated polyester, acidic group excessive polyester, sulfonyl amine of copper phthalocyanine, etc. are proposed. Furthermore, it is proposed to cause a charge controlling agent or radical to react on a graft pigment, such as carbon black, or to cause an electroactive amino acid or COOH radical to react on epoxy radical or COOH radical of resin for obtaining an improved resin, because many dyes and pigments have poor compatibility with resins for toner, thus adversely affecting the life of the developers.

(iv) other ingredients 1. fluidizer

This is added for improving fluidity of toner and developer, and it is typically derived either by mixture of colloidal silica and toner or by applying hydrophobic silica to the surface of toner particles. It is also proposed to add silicone varnish, metal soap, non-ionic surface active agent, particulates of polyvinylidene fluoride, etc.

2. cleaning agent

This is added to prevent toner from filming a photosensitive body and carrier and to facilitate cleaning of the remaining toner on the photosensitive body after transfer of an image. Metallic salts of fatty acids and $SiO_2$ particles having organic radicals on their surfaces are proposed for cleaning agents. It is also proposed to add fluorine surface active agent or the like.

3. filler

Recently, the importance of use of an inactive filler has been increasingly recognized. The advantages include:

(1) improved lustrous surface of a copied image (2) usability as a grinding aid, thus decreasing the energy necessary to grind stubborn resin (3) decreased total cost including raw material cost Potassium carbonate, clay, talc and soft pigments are examples of the filler, and addition of filler as much as 20% by weight is sometimes used.

Triiron tetraoxide having particle diameters ranging from 0.1 to 1 μm, γ-ferric oxide, chrome dioxide, nickel ferrite, iron alloy powder, etc. have been proposed as magnetic powder, and at present triiron tetraoxide is frequently used, it being understood that toner containing 5–70% triiron tetraoxide by weight is prepared. The resistance of toner varies considerably with kind and quantity of magnetic powder, and magnetic material is preferably less than 55% by weight to obtain a sufficient resistance.

If any of the abovementioned material has been milled and ground, then no further process may be required, but the following processes are sometimes added:

(1) An insulative material is added or applied to toner to control the electric resistance.

(2) The surface of magnetic powder is covered with a surface active agent, organic dye or specific resin or activated in advance, and then a coating is formed thereon by polymerization. Thereafter, a resin or the like is added to it to prepare toner. This is mainly aimed at facilitating uniform dispersion of it within the resin and at improving the quality of image when it is humid.

(3) Axial ratio and shape of magnetic powder, and magnetic characteristics, such as coercive force, are appropriately selected so that a latent image is better developed, and splashing of toner is prevented if necessary.

(4) Various magnetic toners differing in particle diameter, quantity of magnetic powder or electric resistance are added so that the fluidity is increased and an image is better developed.

It is noted that many of magnetic materials are black in color, and therefore they are concurrently used as pigments.

Other resins appropriate to toners for pressure fixing methods include wax, polyolefins, ethylene-vinyl acetate copolymer, polyurethane and tacky resins, such as rubber, which are deformed non-elastically by a force of some 20 Kg/cm and stuck to paper. Capsuled toners can be also used.

Usually, the particle mean diameter of these materials is preferably less than about fifty microns in relation to resolution. The instant means imposes no theoretical limitations on particle diameters, but it is usually to be desired that they are approximately 1–30 microns in relation to resolution, splashing of toner and conveyance.

(6) The spatial relations among the developer supporting means, developer regulating and toner are now described. When developer having a high resistance is caused to approach an electrostatically charged latent image, the mirror force and friction generally tend to produce fog even in a region where no charged latent image is present. For this reason, a non-contacting development in which distance $D_1$ between the latent image and developer supporting means is greater than the thickness $d_1$ of the toner layer is preferred. The quantity of toner required for a non-contacting development is equivalent to only several layers of toner, and therefore the toner can be made into a thin layer by conveying most of the toner on the supporting means to the developer regulating means.

An electric force prevents all of the toner from moving from the developer supporting means to the developer regulating means, and the unipolar developer is selectively held on the supporting means. The quantity of the remaining toner depends on the applied voltage, magnetic force and conveyed quantity of toner. In actuality, $d_1$ ranges from 10 to 300 $\mu$m, and $D_1$ ranges from 50 to 1,000 $\mu$m. Further, both values are selected so that $D_1 > d_1$ is satisfied.

(7) Upon developing, the necessity of supplying toner onto an electrostatic latent image requires that the latent image and the developer are opposite in polarity. If a photosensitive substance used in a duplicator is selected, for example, from the group consisting of selenium, zinc oxide, cadmium sulfide, organic semiconductor and amorphous silicon, then insufficiency of illumination on the background portion and insufficiency of disappearance of potential due to trapping by the photosensitive substance often occur. In order to prevent toner from adhering to unwanted places, a DC voltage opposite in polarity to toner, that is a DC voltage component which is the same in polarity with an electrostatic latent image, is applied to the developer supporting means. A layer of toner which is formed by movement of toner from the developer supporting means to the developer regulating means is required to be subjected to an electric field holding the toner that is opposite in polarity to the latent image, because of an electric field generated between both means. For this purpose $v_1-v_2$ should be opposite in sign to the toner, where $v_1$ is the DC voltage component applied to the developer supporting means and $v_2$ is the DC voltage component applied to the developer regulating means. Usually, $v_2$ is zero or opposite in sign to $v_1$.

The value of the DC voltage component applied to the developer supporting means can be greater than the maximum volatage $v_0$ of the latent image, but usually about the same voltage will suffice.

The foregoing can be similarly applied to the DC voltage impressed on the developer conveying means. Since the maximum voltage $v_0$ of the latent image ordinarily used ranges from $\pm 50$ to $\pm 1{,}500$ V, neither $v_1$ nor $v_2$ exceeds 1,500 V at the highest. That is, if the relations $$|v_1/v_2| \leqq 1,$$

$$|v_2/v_0| \leqq 1$$

are satisfied, then a good quality development will be done.

(8) In order to obtain a sharper image, it is effective to produce an alternating electric field between the latent image and supporting means. The effectiveness of an alternating electric field in a noncontacting development is disclosed in U.S. Pat. No. 3,866,574. The time it takes for a toner particle to return is made longer than the time it takes the particle to fly out so as to prevent fog by toner. Such a desired situation will take place if the voltage waveform generating the alternating field and the DC bias applied to the sleeve are appropriately selected.

The quantity of toner is usually several microcoulomb/g, and the distance $D_1$ between the developer supporting means and latent image is several microns. The voltage $v_0$ of the latent image is on the order of several hundred volts. As such, the frequency of the alternating electric field used ranges from several dozen $H_z$ to several dozen $KH_z$, and in practice the range of roughly from 300 $H_z$ to 10 $KH_z$ is preferably used. The alternating component producing the alternating field may be on the same order with the DC component and with the voltage $v_0$ of the latent image, and $\pm 1{,}500$ V at the highest will suffice.

The conveyance of toner from the developer supporting means to the regulating means can be also done by the DC voltage applied between the rollers, and in such a case it is effective to superimpose an additional alternating electric field on the DC voltage. This additional field is also useful to form a uniform layer of toner on the supporting means and can have the same frequency and the same DC component voltage as the electric field acting on between the latent image and supporting means. Of course, if the alternating components are impressed only on the supporting means, then a power supply can be used for both the developing station and conveying portion.

(9) If a layer of toner is formed on the supporting means by an equilibrium process, then a new uniform thin layer of toner can be formed on the supporting means by a new supplying process without the necessity of removing the remaining developer on the supporting means after the development. However, when a film is formed rapidly, the development is made by a transient process. In such a case, it is necessary to remove toner from the surface of the supporting means after development in order that a uniform layer of toner is always assured. The toner can be removed with a wire fur brush, blade, etc., and this operation can be facilitated by the use of a rubber blade made of a synthetic rubber, such as urethane, nitrile, perchlon, neoprene, silicone, etc. or natural rubber. In stead of the rubber blade, a metal plate covered with an elastic resin coating consisting of polyethylene terephthalate or the like or a metal plate having a pressed mesh-like member can be used. If the surface of the supporting means is flattened, the removal will be made easier and will be done more certainly. The removed toner can be kept separated, but it is also possible to return it to the toner box for reuse. The toner removing member can be pressed during only development, and it may be released from the pressing force after development, that is, after the voltage to the supporting means ceases to be applied and the toner on the supporting means has been removed.

(10) The charged toner to be developed is supplied from the developer supporting means, and if such toner lacks the capability to be charged or has a quantity of charge insufficient for development, then a charging means is required to be provided in association with developer. A direct manner is that the means is mounted above the supporting means. Particularly, if it is operated before formation of a thin layer of toner, then it will be useful to stabilize the development.

Frictional charging, charge induction (charge injection) or corona charging is used for such a charging means.

Frictional charging can employ a mechanical force as resulting from rotation of a charging member, such as a fur brush or screw plate. A method in which a magnetic or electric force brings toner into contact with a charging member is also conventionally known.

The charge induction (charge injection) method is carried out by applying a voltage to a blade, sleeve or the like. This is not sufficiently effective for toner having a high resistance. The corona charging employs corona discharge to charge toner.

A particular method used for a particular developing machine is selected out of these methods according to the conditions imposed on the machine.

(11) Even in the presence of massed toners, the structure according to the present invention does not substantially allow the toner to clog up the developing station. Specifically, toner is conveyed from the developer supporting means to the regulating means and thence to the toner container, thus completing a recycling, and only a regulated quantity of toner whose charge is controlled is supplied to the developing station. Even in such a structure, as massed toners increase, they may be conveyed to the developing station and may adversely affect the image. The removal or destruction of these massed toners is accomplished in the present invention by the regulated developer. Specifically, a mesh-like member is placed under the developer regulating means so that developer may pass through the member, whereby separating the massed toners. Vibration of the mesh-like member betters the passage of developer, thus permitting one to break the massed toners into powder.

It is also possible to dispose a magnet above or under the mesh-like member so as to magnetically cause the member to pass through toner, breaking the massed toner into powder.

(12) To stabilize the operation of the developing machine other means may be provided as follows:

(A) When a latent image is developed under an alternating electric field, splashing of toner frequently occurs. Hence, it is effective to dispose magnets above and under the developing station for preventing the splashing. These magnets may be disposed on either the inside or outside of the developer supporting means.

(B) It is also effective to dispose a means for removing massed developers on the developer supporting means. Specifically, a repelling magnetic force (Japanese Patent Laid-Open to Public Inspection No. 141,642/1979), mesh, magnetic blade or the like may be used within the supporting means to remove massed toners on said supporting means.

(C) With respect to control over charge, in addition to control over charge of toner, the materials of the charging member, developer supporting means, developer regulating means and developer removing member, are required to be taken into consideration. Particularly when a frictional charging means is used, the selection of material for electrifying members is important. The aforesaid members preferably consist of materials capable of controlling electrification. To be specific, metal materials or resins opposite in charged polarity to the toner are used. Low resistance of the electrifying members contributes to stabilization of charging, and therefore each electrifying member consist of a metal and a resin. Of course, if the charging controllability of the metal and resin requires, a charge controlling agent will be added. It is also possible to apply a mixed solution to the member or to plate it for formation of a layer.

Thus the composing elements of the present invention have been described, and examples of the invention are now described.

Figure 2:
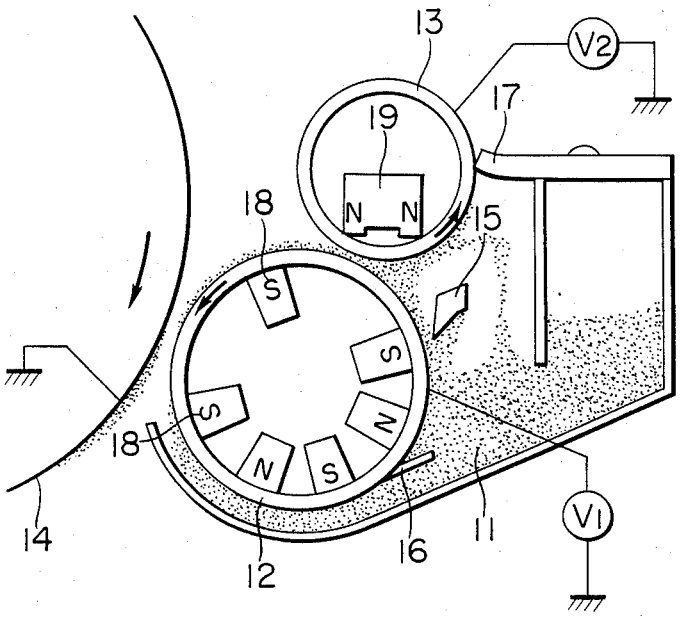
FIG. 2 illustrates the developing device of FIG. 1, wherein the developer regulating means is a sleeve having magnets fixed within it.

FIG. 2 is a cross sectional view of a developing device illustrating the first example of the present invention. A developer supporting means consists essentially of a hollow cylinder 12 of 40 mm in diameter made of non-magnetic stainless steel and is opposed to a Se photosensitive body 14 of 120 mm in diameter with a 0.3 mm space therebetween. Magnets 18 producing a magnetic, field whose intensity is 600 gauss when measured on the cylinder 12, is fixedly arranged in the cylinder. A developer regulating means, having a 1,000 gauss stationary magnet 19 therein, is a hollow cylinder 13 having a diameter of 30 mm. The cylinder 13 consists of non-magnetic stainless steel and is opposed to the cylinder 12 acting as the developer supporting means with a 1.0 mm space therebetween. A developer regulating means for the cylinder 12 is provided by a knife-like non-magnetic stainless steel blade 15 which is opposed to the cylinder forming a 0.5 mm space therebetween. A developer for negative charging containing 30% magnetic material by weight and having a mean particle diameter of 10 micron is used.

In the course of conveyance of developer from the toner container 11 toward the photosensitive body 14, the conveyed quantity is regulated to a certain value by the knife blade 15 made of magnetic stainless steel. Then the toner is rotated on cylinder 12 adjacent to the vicinity of cylinder 13 for regulating the developer, whereupon an applied voltage holds the developer having a desired polarity and a layer thickness of 50 micron on the cylinder 12 while removing the remainder onto cylinder 13. An electrostatic latent image, which has a maximum voltage of 600 V and has been formed on the Se photosensitive body 14, is made visible by the developer brought into the development area the cylinder 12.

The linear velocity of the Se photosensitive body 14 at the developing station is 180 mm/sec, and the cylinder 12 for supporting developer rotates at the same linear velocity in the same direction.

Then the cylinder 13 for regulating developer is maintained at ground potential ($V_2=0$), and AC 400 V, 500 $H_z$ and a superimposed voltage (DC+200 V) for $V_1$ are applied to the cylinder 12 for supporting developer to perform a development.

Developer adhering to the latent image on the Se photosensitive body 14 is transferred to paper at a transfer station. Developer on the cylinders 12 and 13 is removed by scraper members 16 and 17, and then it is returned to the toner container 11 if necessary.

The example described above permits a development which produces a quite good quality of visible image.

The second example is also illustrated in FIG. 2 but differs from the first example in the following respects. The knife blade 15 is opposed to the cylinder 12 for supporting developer with a 0.7 mm space therebetween and acts to regulate developer on the cylinder. The Se photosensitive body 14 rotates at a linear velocity of 180 mm/sec, while the cylinder 12 rotates at a velocity two times the linear velocity in the same direction. The cylinder 13 rotates also at the doubled linear velocity but in the opposite direction. A layer of toner having a thickness if 20 microns is held on the cylinder 12 before the developer is conveyed toward the photosensitive body 14. This example also allows a superior development. Particularly, even when the latent image has a considerable area to be developed as black whole, toner is sufficiently supplied preventing blur and the like.

The third example is also illustrated in FIG. 2 but differs from the first example in the following respects. A developer for negative charging contains 10% magnetic material by weight and has a mean particle diameter of 5 microns. The toner layer of developer, which is formed on the cylinder 12 and is to be conveyed to the photosensitive body 14, has a thickness of 20 microns. This example similarly enables an excellent development.

The fourth example is also illustrated in FIG. 2 and similar to the first example except in the following respects. The Se photosensitive body 14 has a diameter of 120 mm, and the cylinder 12 for supporting developer is opposed thereto defining a space of 0.1 mm in between them. Also, the cylinders 13 and 12 are opposed to each other with a space of 0.5 mm therebetween. A layer of toner having a thickness of 20 microns which is to be conveyed toward the photosensitive body 14 is held on the cylinder 12. This example also permits an excellent development.

The fifth example is also illustrated in FIG. 2 and has the same mechanical conditions as the first example has. But this example is characterized by the following electrical conditions. The voltage $V_2$ applied to the cylinder 13 is DC−100 V, while the voltage $V_1$ applied to the cylinder 12 is AC 400 V, 500 $H_z$ plus DC+100 V. This example also assures a good development.

Figure 3:
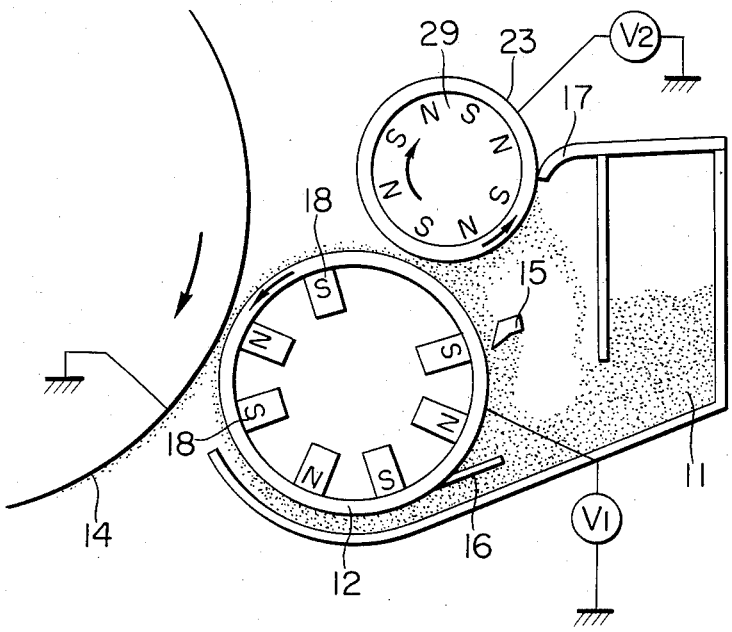
FIG. 3 illustrates the developing device of FIG. 1, wherein the developer regulating means is a sleeve having a rotatable magnet roll within it.

Referring to FIG. 3, there is illustrated the sixth example which differs from the first example in the following respects. The developer regulating means is a hollow cylinder 23 for regulating development which is made of non-magnetic stainless steel. The cylinder has a diameter of 30 mm and holds rotary, 600 gauss magnets 29 therein so that the north poles and south poles are alternately arranged. The magnets 29 are rotated at a velocity of 1,000 rpm in the direction indicated by the arrow. This example also permits a good development.

Figure 4:
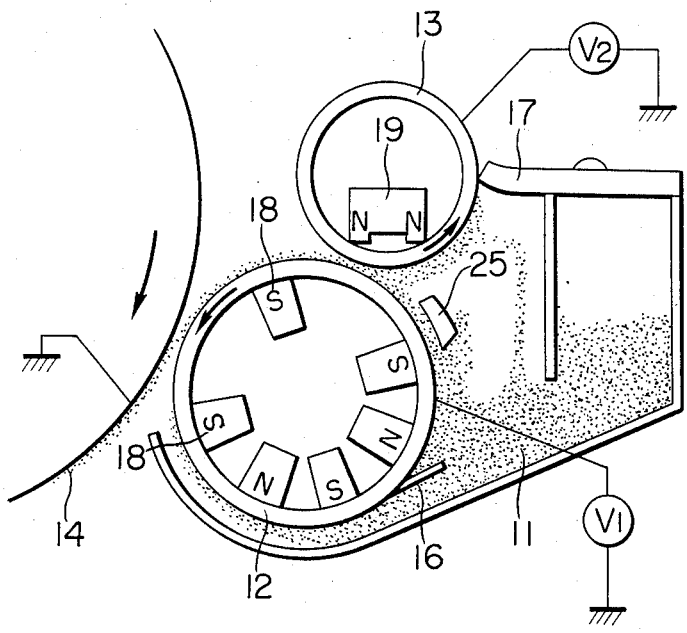
FIG. 4 shows a further example of the developing device of FIG. 2 provided with a preliminary regulating plate.

Referring next to FIG. 4, there is illustrated the seventh example which differs from the first example in the following respects. A plate 25 made of non-magnetic stainless steel which acts to preliminarily regulate the developer on the developer supporting cylinder 12 and to electrify it. Plate 25 is opposed to the cylinder 12 with a 0.5 mm space therebetween. An alternating electric field developed between the stainless steel plate 25 and cylinder 12 preliminarily regulates the quantity of conveyed toner and charges toner. This example also allows a good development.

Figure 5:
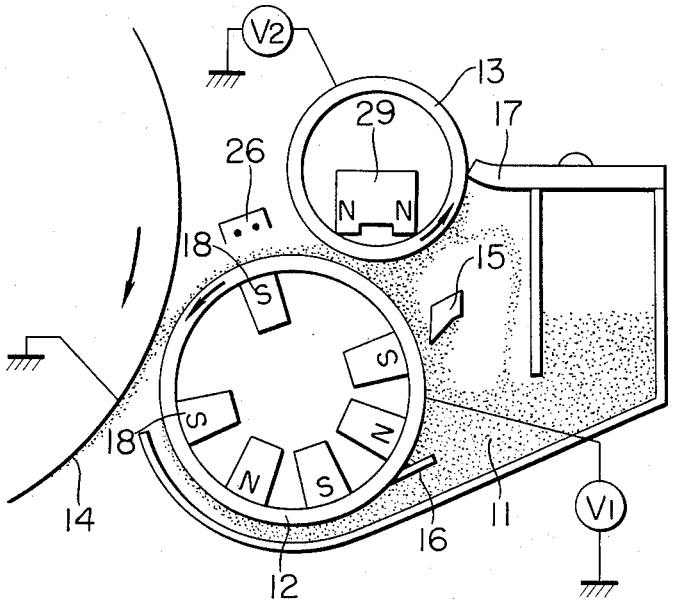
FIG. 5 shows the developing device of FIG. 2 provided with a charging corona to increase the quantity of charge of the toner.

Referring next to FIG. 5, there is illustrated the eighth example which differs from the first example in having a charging electrode 26 for generating an electric corona to increase the quantity of charge of the toner, which has a thickness of 50 microns and is held on the cylinder 12 prior to its conveyance.

Figure 6:
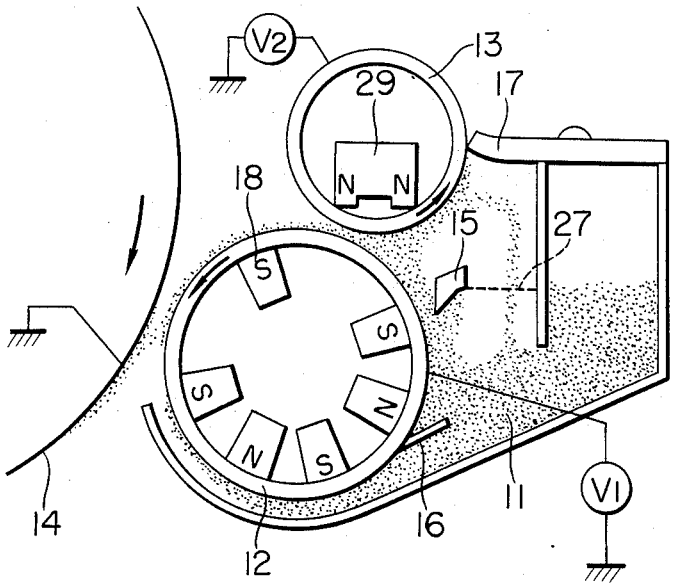
FIG. 6 shows the developing device of FIG. 2 provided with a vibrating mesh screen for breaking up massed toner.

Referring next to FIG. 6, there is illustrated the ninth example that is similar to the first example, in which toner adhering to the cylinder 13 for regulating developer is scraped off by the blade 17 and removed and then it is returned to the toner container 11, except that toner is caused to pass through a vibrating 100-mesh screen 27 disposed under the blade prior to its recovery. The result is that massed toners are broken into powder, and caked developer and mixed foreign objects are separated and deposited on a screen 27. It is found that all the aforementioned examples enable a good development.

What is claimed is:

1. In a developing method for an electrostatic latent image comprising the steps of forming a layer of developer on the surface of a developer supporting means, and conveying the developer on said developer supporting means to a development area, the improvement which comprises regulating the quantity of developer on said developer supporting means by a developer regulating means before the developer is conveyed to the development area, by impressing a bias voltage so as to establish a field between said developer supporting means and said developer regulating means for selectively removing developer from said developer supporting means in accordance with a charged state of said developer, and developing an electrostatic latent image by applying developer retained on said developer supporting means to the development area.

2. A developing method according to claim 1, wherein said developer is a one-component developer.

3. A developer method according to claim 1, wherein said developer is a one-component magnetic developer.

4. A developing method according to claim 1, wherein said developer is a one-component magnetic developer and said developer supporting means is a magnetic force.

5. A developing method according to claim 4, wherein said developer regulating means is a regulating means having a magnetic force.

6. A developing method according to claim 5, wherein said developer regulating means comprises a non-magnetic member and a magnet therein.

7. A developing method according to claim 4, wherein the relation of a linear velocity ($v_0$) of the surface of the charge receptor, a linear velocity ($v_1$) of the developer supporting means and a linear velocity ($v_2$) of the developer regulating means is represented by following formulas:

$$|v_0| \leqq |v_1|/2,$$

$$|v_1| \leqq |v_2|/2.$$

8. A developing method according to claim 1, wherein the relation of a linear velocity ($v_0$) of the charge receptor and a linear velocity ($v_1$) of the developer supporting means is represented by following formula:

$$v_0/v_1 \leqq \frac{1}{2}.$$

9. A developing method according to claim 3, wherein said developer comprises a magnetic material of 5–55% by weight.

10. A developing method according to claim 9, wherein a mean diameter of said developer particle is a range from 1 micron to 30 microns.

11. A developing method according to claim 3, wherein the relation of a distance ($D_1$) between said charge receptor and said developer supporting means, and the thickness ($d_1$) of said developer on the surface of said developer supporting means is represented by following formula:

$$D_1 > d_1.$$

12. A developing method according to claim 3, wherein DC voltage component ($V_1$) applied to said developer supporting means is zero or the same with the maximum surface potential ($V_0$) of said electrostatic latent image, and DC voltage component ($V_2$) applied to said developer regulating means is zero or opposite in sign to the potential ($V_0$).

13. A developing method according to claim 12, wherein $$|V_1/V_0| \leqq 1,$$

and $$|V_2/V_0| \leqq 1.$$

14. A developing method according to claim 1, wherein an alternating electric field is applied between the surface on which the electrostatic latent image and said developing supporting means.

15. A developing method according to claim 1, wherein alternating electric field is applied between said developer supporting means and said developer regulating means.

16. A developing method according to claim 1, wherein said method further comprises a cleaning a residual developer on the surface of the developer supporting means after development.

17. A developing method according to claim 1, wherein said method further comprises a charging a developer on the surface of said developer supporting means before development.

18. A developing method according to claim 1, wherein said method further comprises a removing and/or destroying the developer has been caked in the conveyance of the developer.

19. The developing method according to claim 1, wherein said developer regulating means is a device applying a magnetic force.

20. The developing method according to claim 1, wherein said developer regulating means is a non-magnetic member having a magnet therein.

21. The developing method according to claim 1, wherein said developer supporting means comprises a non-magnetic cylinder and a magnet therein, and the step of conveying developer to the development area is performed by rotating said cylinder.

22. In a developing apparatus for an electrostatic latent image comprising developer supporting means for retaining developer on a surface thereof and for conveying developer to a development area, wherein the improvement comprises a developer regulating means adjacent said developer supporting means for regulating the quantity of developer on said developer supporting means by impressing a bias voltage so as to establish a field between said developer supporting means and said developer regulating means for selectively removing developer from said developer supporting means in accordance with a charged state of said developer.

23. The developing apparatus of claim 22, wherein said developer regulating means includes means applying a magnetic force.

24. The developing apparatus of claim 22, wherein said developer regulating means comprises a non-magnetic member and a magnet therein.

25. The developing apparatus according to claim 22, wherein said developer regulating means includes preliminary regulating means for limiting the quantity of developer on said developer supporting means.

26. In a developing method for an electrostatic latent image comprising the steps of forming a layer of developer on the surface of a developer supporting means, conveying the developer on said developer supporting means to a development area, wherein the improvement comprises regulating the quantity of developer on said developer supporting means by a developer regulating means, before the developer is conveyed to the development area, by impressing a bias voltage so as to establish a field between said developer supporting means and said developer regulating means for selectively removing developer from said developer supporting means in accordance with a charged state of said developer, and developing an electrostatic latent image by applying developer retained on said developer supporting means to the development area.

27. In a developing apparatus for an electrostatic latent image comprising developer supporting means for retaining developer on a surface thereof and for conveying developer to a development area, wherein the improvement comprises a developer regulating means adjacent said developer supporting means for regulating the quantity of developer on said developer supporting means by impressing a bias voltage so as to establish a field between said developer supporting means and said developer regulating means for selectively removing developer from said developer supporting means in accordance with a charged state of said developer.

* * * * *